US010885839B2

(12) United States Patent
Wang

(10) Patent No.: US 10,885,839 B2
(45) Date of Patent: Jan. 5, 2021

(54) PIXEL CIRCUIT AND DRIVING METHOD THEREOF, AND DISPLAY DEVICE

(71) Applicants: BOE TECHNOLOGY GROUP CO., LTD., Beijing (CN); ORDOS YUANSHENG OPTOELECTRONICS CO., LTD., Inner Mongolia (CN)

(72) Inventor: Bo Wang, Beijing (CN)

(73) Assignees: BOE TECHNOLOGY GROUP CO., LTD., Beijing (CN); ORDOS YUANSHENG OPTOELECTRONICS CO., LTD., Ordos (CN)

( * ) Notice: Subject to any disclaimer, the term of this patent is extended or adjusted under 35 U.S.C. 154(b) by 0 days.

(21) Appl. No.: 16/313,494

(22) PCT Filed: Jun. 26, 2018

(86) PCT No.: PCT/CN2018/092832
§ 371 (c)(1),
(2) Date: Dec. 27, 2018

(87) PCT Pub. No.: WO2019/037536
PCT Pub. Date: Feb. 28, 2019

(65) Prior Publication Data

US 2019/0164488 A1 May 30, 2019

(30) Foreign Application Priority Data

Aug. 23, 2017 (CN) ..... 2017 1 0731593

(51) Int. Cl.
*G09G 3/36* (2006.01)
*G09G 3/30* (2006.01)
(Continued)

(52) U.S. Cl.
CPC ..... *G09G 3/3233* (2013.01); *G09G 3/3258* (2013.01); *G09G 3/3266* (2013.01);
(Continued)

(58) Field of Classification Search
CPC .. G09G 3/32; G09G 3/30; G09G 3/36; G09G 5/00; G06F 3/038
See application file for complete search history.

(56) References Cited

U.S. PATENT DOCUMENTS 8,362,986 B2 * 1/2013 Ishiguro ..... G09G 3/3233 345/76
9,601,057 B2 3/2017 Liu et al.
(Continued)

FOREIGN PATENT DOCUMENTS

CN 202855271 U 4/2013
CN 104050917 A 9/2014
(Continued)

OTHER PUBLICATIONS

International Search Report dated Aug. 20, 2018 issued in corresponding Application No. PCT/CN2018/092832.
(Continued)

*Primary Examiner* — Pegeman Karimi
(74) *Attorney, Agent, or Firm* — Nath, Goldberg & Meyer; Joshua B. Goldberg

(57) ABSTRACT

A pixel circuit, a method for driving a pixel circuit and a display device are provided. The pixel circuit includes a reset and precharge sub-circuit, a scanning compensation sub-circuit, a driving sub-circuit and a light-emission control sub-circuit, the scanning compensation sub-circuit comprises a storage capacitor, the light-emission control sub-circuit is configured to control a light-emitting device to emit light, the reset and precharge sub-circuit is coupled to the scanning compensation sub-circuit and the light-emis-
(Continued)

sion control sub-circuit, and is configured to reset the light-emission control sub-circuit according to a reset signal, and reset a second electrode of the storage capacitor of the scanning compensation sub-circuit according to a scanning signal; the scanning compensation sub-circuit is further coupled to the driving sub-circuit and the light-emission control sub-circuit, and is configured to charge the storage capacitor of the scanning compensation sub-circuit according to the scanning signal.

14 Claims, 2 Drawing Sheets

(51) Int. Cl.

| | |
|---|---|
| ***G09G 3/3233*** | (2016.01) |
| ***G09G 3/3258*** | (2016.01) |
| ***G09G 3/3291*** | (2016.01) |
| ***G09G 3/3266*** | (2016.01) |

(52) U.S. Cl.

CPC ..... *G09G 3/3291* (2013.01); *G09G 2300/043* (2013.01); *G09G 2300/0439* (2013.01); *G09G 2300/0809* (2013.01); *G09G 2300/0814* (2013.01); *G09G 2300/0819* (2013.01); *G09G 2310/0251* (2013.01); *G09G 2310/0278* (2013.01); *G09G 2320/0233* (2013.01)

(56) References Cited

U.S. PATENT DOCUMENTS

| | | | | |
|---|---|---|---|---|
| 10,255,859 | B2 | 4/2019 | Wang et al. | |
| 10,347,181 | B2 | 7/2019 | Zhu et al. | |
| 2002/0118150 | A1* | 8/2002 | Kwon | G09G 3/3233 345/76 |
| 2012/0105501 | A1* | 5/2012 | Nakamura | G09G 3/3233 345/690 |
| 2013/0063498 | A1* | 3/2013 | Yabukane | G09G 3/3225 345/690 |
| 2015/0287364 | A1* | 10/2015 | Chang | G09G 3/3258 345/77 |
| 2015/0379934 | A1 | 12/2015 | Xiaoling | |
| 2016/0275869 | A1 | 9/2016 | Hwang et al. | |
| 2018/0047337 | A1 | 2/2018 | Zhu et al. | |
| 2018/0240406 | A1 | 8/2018 | Wang et al. | |

FOREIGN PATENT DOCUMENTS

| | | | |
|---|---|---|---|
| CN | 105243986 | A | 1/2016 |
| CN | 106782321 | A | 5/2017 |
| CN | 106910468 | A | 6/2017 |
| CN | 106935199 | A | 7/2017 |

OTHER PUBLICATIONS

First Office Action dated Dec. 31, 2019, for corresponding Chinese application 201710731593.2.

* cited by examiner

PIXEL CIRCUIT AND DRIVING METHOD THEREOF, AND DISPLAY DEVICE

CROSS-REFERENCE TO RELATED APPLICATION

This is a National Phase Application filed under 35 U.S.C. 371 as a national stage of PCT/CN2018/092832, filed Jun. 26, 2018, an application claiming the benefit of Chinese Application No. 201710731593.2, filed Aug. 23, 2017, the content of each of which is hereby incorporated by reference in its entirety.

TECHNICAL FIELD

The present disclosure relates to the field of display technology, and particularly relates to a pixel circuit, a driving method thereof, and a display device.

BACKGROUND

With the development of science and technology, flat panel display devices have replaced heavy CRT display devices and become more and more popular in people's daily lives. At present, commonly-used flat panel display devices include liquid crystal displays (LCDs), organic light-emitting diode (OLED) displays and quantum dot light emitting diode (QLED) displays. Due to their self-luminescent properties, OLEDs and QLEDs have been widely studied in the display field.

SUMMARY

One aspect of the present disclosure provides a pixel circuit, including a light-emitting device, a reset and precharge sub-circuit, a scanning compensation sub-circuit, a driving sub-circuit and a light-emission control sub-circuit, and the scanning compensation sub-circuit includes a storage capacitor, and the light-emitting device emits light under the control of the light-emission control sub-circuit so as to perform display;

the reset and precharge sub-circuit is coupled to the scanning compensation sub-circuit and the light-emission control sub-circuit, and is configured to reset the light-emission control sub-circuit according to a reset signal, and precharge the storage capacitor of the scanning compensation sub-circuit according to a scanning signal;

the scanning compensation sub-circuit is further coupled to the driving sub-circuit and the light-emission control sub-circuit, and is configured to charge the storage capacitor of the scanning compensation sub-circuit according to the scanning signal, so as to compensate for the driving sub-circuit;

the driving sub-circuit is further coupled to the light-emission control sub-circuit, and is configured to provide a driving current for the light-emitting device via the light-emission control sub-circuit; and the light-emission control sub-circuit is further coupled to the light-emitting device, and is configured to control the light-emitting device to emit light according to a light-emission control signal.

In an embodiment, the scanning compensation sub-circuit includes a first transistor, a second transistor, a fourth transistor and the storage capacitor, the first transistor has a control electrode used for receiving the scanning signal, a first electrode coupled to a first electrode of the storage capacitor, and a second electrode used for receiving a data signal;

the second transistor has a control electrode used for receiving the scanning signal, a first electrode coupled to the driving sub-circuit and the light-emission control sub-circuit, and a second electrode coupled to a second electrode of the fourth transistor and the reset and precharge sub-circuit;

the fourth transistor has a control electrode used for receiving the scanning signal, a first electrode coupled to a second electrode of the storage capacitor and the driving sub-circuit, and the second electrode further coupled to the reset and precharge sub-circuit; and the first electrode of the storage capacitor is further coupled to the light-emission control sub-circuit and serves as a first node, and the second electrode of the storage capacitor is further coupled to the driving sub-circuit and serves as a second node.

In an embodiment, the driving sub-circuit includes a third transistor which has a control electrode coupled to the second node, a first electrode coupled to the first electrode of the second transistor and the light-emission control sub-circuit, and a second electrode used for receiving a first voltage.

In an embodiment, the light-emission control sub-circuit includes a fifth transistor and a sixth transistor, the fifth transistor has a control electrode coupled to a first electrode thereof and used for receiving the light-emission control signal, and a second electrode coupled to the first node; and the sixth transistor has a control electrode used for receiving the light-emission control signal, a first electrode coupled to both the reset and precharge sub-circuit and the light-emitting device, and a second electrode coupled to the first electrode of the third transistor and the first electrode of the second transistor.

In an embodiment, the reset and precharge sub-circuit includes a seventh transistor and an eighth transistor, the seventh transistor has a control electrode coupled to a first electrode thereof and used for receiving the reset signal, and a second electrode coupled to the second electrode of the fourth transistor; and the eighth transistor has a control electrode coupled to a first electrode thereof and used for receiving the reset signal, and a second electrode coupled to the first electrode of the sixth transistor and the light-emitting device.

In an embodiment, the first to the eighth transistors each are a P-type transistor.

In an embodiment, the light-emitting device is an organic light-emitting diode or a quantum dot light emitting diode.

Another aspect of the present disclosure provides a display device, including a plurality of the foregoing pixel circuits.

Another aspect of the present disclosure provides a method for driving the foregoing pixel circuit, which includes a light-emitting device, a reset and precharge sub-circuit, a scanning compensation sub-circuit, a driving sub-circuit and a light-emission control sub-circuit, the scanning compensation sub-circuit includes a storage capacitor, and the light-emitting device emits light under the control of the light-emission control sub-circuit so as to perform display, the reset and precharge sub-circuit is coupled to the scanning compensation sub-circuit and the light-emission control sub-circuit, and is configured to reset the light-emission control sub-circuit according to a reset signal, and precharge the storage capacitor of the scanning compensation sub-circuit according to a scanning signal, the scanning compensation sub-circuit is further coupled to the driving sub-circuit and the light-emission control sub-circuit, and is configured to charge the storage capacitor of the scanning compensation sub-circuit according to the scanning signal, so as to compensate for the driving sub-circuit, the driving sub-circuit is further coupled to the light-emission control sub-circuit, and is configured to provide a driving current for the light-emitting device via the light-emission control sub-circuit, and the light-emission control sub-circuit is further coupled to the light-emitting device, and is configured to control the light-emitting device to emit light according to a light-emission control signal, and the method includes steps of:

in a reset and precharge stage, resetting the reset and precharge sub-circuit and precharging the storage capacitor of the scanning compensation sub-circuit according to the reset signal and the scanning signal;

in a compensation charging stage, charging the storage capacitor of the scanning compensation sub-circuit according to the scanning signal so as to compensate for the driving sub-circuit; and in a light-emission driving stage, driving the light-emitting device to emit light according to the light-emission control signal and the data signal.

In an embodiment, the scanning compensation sub-circuit includes a first transistor, a second transistor, a fourth transistor and the storage capacitor, the storage capacitor has a first electrode serving as a first node, and a second electrode serving as a second node, the driving sub-circuit includes a third transistor, the light-emission control sub-circuit includes a fifth transistor and a sixth transistor, the reset and precharge sub-circuit includes a seventh transistor and an eighth transistor;

the reset and precharge stage includes a first sub-stage and a second sub-stage, and the method includes steps of:

in the first sub-stage, validating the reset signal such that the seventh transistor and the eighth transistor are turned on; and in the second sub-stage, validating the reset signal and the scanning signal such that the first transistor, the second transistor and the fourth transistor are turned on, the first node is precharged to a voltage of the data signal, and a potential of the second node is at low level;

in the compensation charging stage, validating the scanning signal such that the first transistor, the second transistor and the fourth transistor are turned on, the control electrode and the first electrode of the third transistor are electrically coupled to each other, a potential of the first node is kept unchanged, and a voltage of the second node is charged via the third transistor; and in the light-emission driving stage, validating the light-emission control signal such that the fifth transistor and the sixth transistor are turned on, and a voltage difference between the first node and the second node is maintained to be equal to that between the first node and the second node when the compensation charging stage is complete.

In an embodiment, in the reset and precharge stage, duration of the first sub-stage is the same as that of the second sub-stage.

In an embodiment, the first to eighth transistors each are a P-type transistor, and each of the reset signal, the scanning signal, the light-emission control signal and the data signal is valid when being at low level.

DETAILED DESCRIPTION

In order to enable those skilled in the art to better understand the technical solutions of the present disclosure, the pixel circuit, the driving method thereof, and the display device of the present disclosure will be further described in detail below with reference to the accompanying drawings and specific implementations.

In a display device, a current is made unstable due to shift of a threshold voltage Vth of a driving transistor in a pixel circuit, so that different driving currents are generated when the same data driving signal DATA is provided for an OLED and a QLED, which further affects uniformity and display quality of a whole display image.

Therefore, engineers have focused on the study of threshold compensation mechanism of a pixel circuit for a long time.

In view of the above shortcomings of the prior art, the present disclosure provides a pixel circuit, a driving method thereof, and a display device, which can effectively eliminate the influence of the threshold voltage Vth of the driving transistor on the driving current of the OLED or QLED.

In an embodiment of the present disclosure, based on a current driving principle which enables self-luminescence of an OLED or a QLED, compensation is made for the influence of shift of the threshold voltage Vth on the driving current in the pixel circuit, so as to prevent non-uniform luminance caused by the influence of the threshold voltage Vth of the driving transistor on the driving current of the OLED or QLED, thereby obtaining a display device having uniform luminance.

Figure 1:
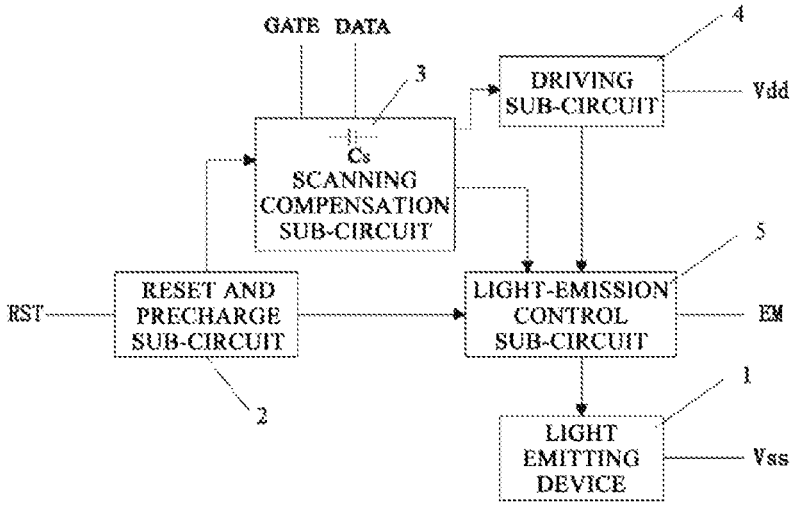
FIG. 1 is a structural block diagram of a pixel circuit according to an embodiment of the present disclosure.

FIG. 1 is a structural block diagram of a pixel circuit according to an embodiment of the present disclosure. As shown in FIG. 1, the pixel circuit includes a light-emitting device 1, a reset and precharge sub-circuit 2, a scanning compensation sub-circuit 3, a driving sub-circuit 4 and a light-emission control sub-circuit 5, the scanning compensation sub-circuit 3 includes a storage capacitor Cs, the light-emitting device 1 emits light under the control of the light-emission control sub-circuit 5 so as to perform display;

the reset and precharge sub-circuit 2 is coupled to the scanning compensation sub-circuit 3 and the light-emission control sub-circuit 5, and is configured to reset the light-emission control sub-circuit 5 according to a reset signal RST, and precharge the storage capacitor Cs of the scanning compensation sub-circuit 3 according to a scanning signal GATE;

the scanning compensation sub-circuit 3 is further coupled to the driving sub-circuit 4 and the light-emission control sub-circuit 5, and is configured to charge the storage capacitor Cs of the scanning compensation sub-circuit 3 according to the scanning signal GATE, so as to compensate for the driving sub-circuit 4;

the driving sub-circuit 4 is further coupled to the light-emission control sub-circuit 5, and is configured to provide a driving current for the light-emitting device 1 via the light-emission control sub-circuit 5; and the light-emission control sub-circuit 5 is further coupled to the light-emitting device 1, and is configured to control the light-emitting device 1 to emit light according to a light-emission control signal EM.

Figure 2:
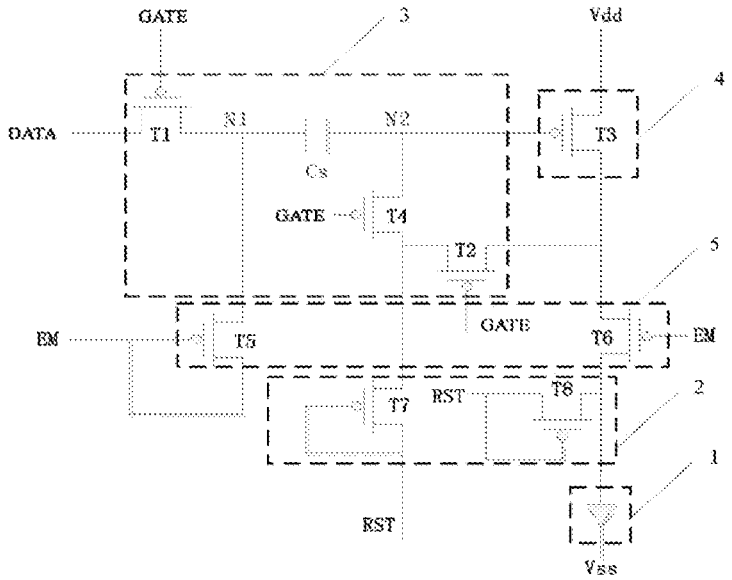
FIG. 2 is a circuit diagram of the pixel circuit in FIG. 1.

In an embodiment, FIG. 2 shows a circuit principle diagram of the pixel circuit in FIG. 1, and each sub-circuit will be described below in detail.

The scanning compensation sub-circuit 3 includes a first transistor T1, a second transistor T2, a fourth transistor T4 and the storage capacitor Cs, the first transistor T1 has a control electrode used for receiving the scanning signal GATE, a first electrode coupled to a first electrode of the storage capacitor Cs, and a second electrode used for receiving a data signal DATA;

the second transistor T2 has a control electrode used for receiving the scanning signal GATE, a first electrode coupled to the driving sub-circuit 4 and the light-emission control sub-circuit 5, and a second electrode coupled to a second electrode of the fourth transistor T4 and the reset and precharge sub-circuit 2;

the fourth transistor T4 has a control electrode used for receiving the scanning signal GATE, a first electrode coupled to a second electrode of the storage capacitor Cs and the driving sub-circuit 4, and the second electrode further coupled to the reset and precharge sub-circuit 2; and the first electrode of the storage capacitor Cs is further coupled to the light-emission control sub-circuit 5 and serves as a first node N1, and the second electrode of the storage capacitor Cs is further coupled to the driving sub-circuit 4 and serves as a second node N2.

The driving sub-circuit 4 includes a third transistor T3 which has a control electrode coupled to the second node N2, a first electrode coupled to the first electrode of the second transistor T2 and the light-emission control sub-circuit 5, and a second electrode used for receiving a first voltage Vdd input from the outside.

The light-emission control sub-circuit 5 includes a fifth transistor T5 and a sixth transistor T6, the fifth transistor T5 has a control electrode coupled to a first electrode thereof and used for receiving a light-emission control signal EM, and a second electrode coupled to the first node N1; and the sixth transistor T6 has a control electrode used for receiving the light-emission control signal EM, a first electrode coupled to both the reset and precharge sub-circuit 2 and the light-emitting device 1, and a second electrode separately coupled to the first electrode of the third transistor T3 and the first electrode of the second transistor T2.

The reset and precharge sub-circuit 2 includes a seventh transistor T7 and an eighth transistor T8, the seventh transistor T7 has a control electrode coupled to a first electrode thereof and used for receiving the reset signal RST, and a second electrode coupled to the second electrode of the fourth transistor T4 as described above; and the eighth transistor T8 has a control electrode coupled to a first electrode thereof and used for receiving the reset signal RST, and a second electrode coupled to the first electrode of the sixth transistor T6 and the light-emitting device 1.

The transistor employed in the embodiment of the present disclosure may be a thin film transistor, a field effect transistor or any other device having the same characteristics. The transistor employed in the present disclosure has symmetrical source and drain, and therefore there is no difference between the source and the drain. In order to distinguish between the two electrodes of the transistor except for the control electrode (i.e., a gate), one electrode is named as a source, and the other electrode is named as a drain. Moreover, the transistor may be classified as an N-type transistor or a P-type transistor in terms of the characteristics thereof, and the type of each component in the pixel circuit may be flexibly selected according to the situation in practice. In the pixel circuit of the embodiment, all of the transistors, from the first transistor T1 to the eighth transistor T8, are P-type transistors. In another embodiment, all of the transistors, from the first transistor T1 to the eighth transistor T8, may be N-type transistors. In other embodiments, from the first transistor T1 to the eighth transistor T8, some may be N-type transistors, and the others may be P-type transistors. It can be easily understood that a first electrode may be a source and a second electrode may be a drain in the case that an N-type transistor is employed, and a first electrode may be a drain and a second electrode may be a source in the case that a P-type transistor is employed.

Correspondingly, the embodiment further provides a method for driving the foregoing pixel circuit, which is used for compensating for a threshold voltage Vth of a driving transistor to eliminate the influence of the threshold voltage Vth on a driving current of an OLED or a QLED, so as to obtain a pixel circuit having uniform luminance.

Figure 3:
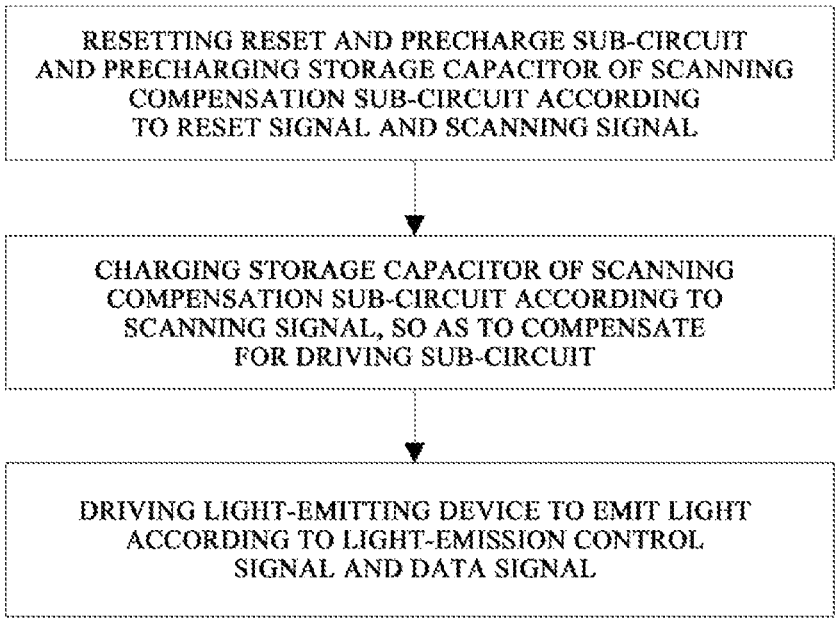
FIG. 3 is a flowchart illustrating a method for driving a pixel circuit according to an embodiment of the present disclosure.

FIG. 3 is a flowchart illustrating a method for driving a pixel circuit according to an embodiment of the present disclosure. As shown in FIG. 3, the driving method includes:

in a reset and precharge stage, resetting a reset and precharge sub-circuit and precharging a storage capacitor of a scanning compensation sub-circuit according to a reset signal and a scanning signal;

in a compensation charging stage, charging the storage capacitor of the scanning compensation sub-circuit according to the scanning signal, so as to compensate for a driving sub-circuit; and in a light-emission driving stage, driving a light-emitting device to emit light according to a light-emission control signal and a data signal.

It should be noted that, the method may be applied to the pixel circuit shown in FIG. 1 and FIG. 2. For example, the reset and precharge sub-circuit, the scanning compensation sub-circuit, the driving sub-circuit, the storage capacitor and the light-emitting device in the method may be the reset and precharge sub-circuit 2, the scanning compensation sub-circuit 3, the driving sub-circuit 4, the storage capacitor Cs and the light-emitting device 1 which are shown in FIG. 1 and FIG. 2; and the reset signal, the scanning signal, the light-emission control signal and the data signal in the method may be the reset signal RST, the scanning signal GATE, the light-emission control signal EM and the data signal DATA which are shown in FIG. 1 and FIG. 2.

Figure 4:
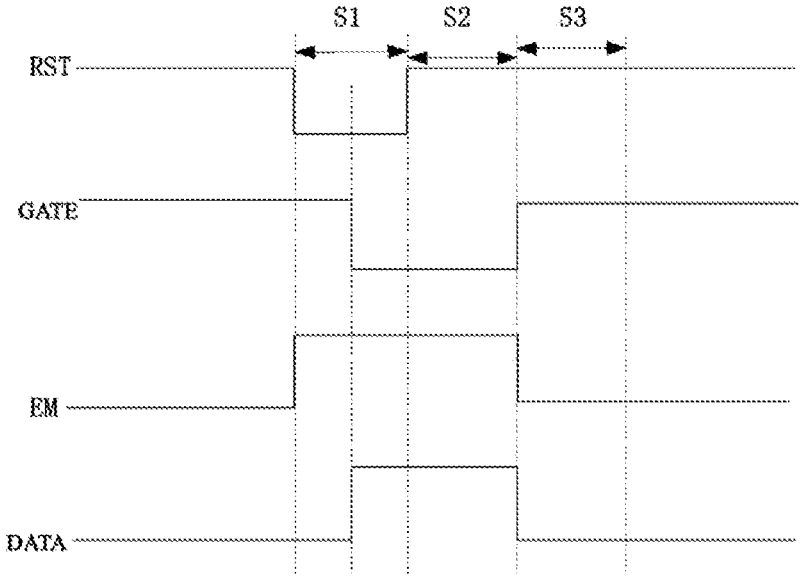
FIG. 4 is a timing diagram of signals in the method for driving a pixel circuit in FIG. 3.

FIG. 4 is a timing diagram of signals in the method for driving a pixel circuit in FIG. 3. A working principle of the pixel circuit which adopts the method is described below with reference to FIG. 4.

In the reset and precharge stage S1, operation of the pixel circuit may be further divided into two steps, that is, a first sub-stage and a second sub-stage. In the first sub-stage, the reset signal RST is valid, the seventh transistor T7 and the eighth transistor T8 are turned on, and a data signal of a previous frame is reset; and in the second sub-stage, the reset signal RST and the scanning signal GATE are valid, the first transistor T1, the second transistor T2 and the fourth transistor T4 are turned on, the first node N1 is precharged to a voltage Vdata of the data signal DATA, and a potential of the second node N2 is at low level. That is, the first sub-stage of S1 (i.e., the reset signal RST is at low level, and the scanning signal GATE is at high level) is a reset step, at this time, the seventh transistor T7 and the eighth transistor T8 are turned on, and the data signal of the previous frame is reset because the eighth transistor T8 is turned on; and the second sub-stage of S1 (i.e., the reset signal RST is at low level, and the scanning signal GATE is at low level) is a precharge step, at this time, the first transistor T1, the second transistor T2, the fourth transistor T4, the seventh transistor T7 and the eighth transistor T8 are all turned on, and a potential of the first node N1 is equal to the voltage Vdata of the data signal DATA, and the potential of the second node N2 is at low level, the same as that of the reset signal RST.

In the compensation charging stage S2, the scanning signal GATE is valid, the first transistor T1, the second transistor T2 and the fourth transistor T4 are still turned on, the third transistor T3 serves as a diode, the potential of the first node N1 is equal to the voltage Vdata of the data signal DATA, and a potential of the second node N2 is equal to Vdd+Vth, where Vdd is a first voltage input from the outside, and Vth is a threshold voltage of the third transistor T3. That is, in the compensation charging stage S2, the scanning signal GATE is at low level, the reset signal RST is at high level, the seventh transistor T7 and the eighth transistor T8 are turned off, while the first transistor T1, the second transistor T2 and the fourth transistor T4 are still turned on, at this time, a gate and a drain of the third transistor T3 are shorted via the second transistor T2 and the fourth transistor T4 to serve as a diode, the third transistor T3 is charged from the first voltage Vdd until the potential of the second node N2 is charged to Vdd+Vth (i.e., a voltage difference between the gate and the source of the third transistor T3 is equal to Vth), but the potential of the first node N1 is still equal to Vdata, so that a voltage difference between the second node N2 and the first node N1 is equal to Vdd+Vth-Vdata.

In the light-emission driving stage S3, the light-emission control signal EM is valid, the fifth transistor T5 and the sixth transistor T6 are turned on, a gate-source voltage of the third transistor T3 is Vth-Vdata+$V_{EM}$, where $V_{EM}$ is a voltage of the light-emission control signal, and a current of the light-emitting device 1 is $K(V_{EM}\text{-Vdata})^2$ which shows that the current of the light-emitting device 1 is independent of the threshold voltage Vth of the driving transistor. Specifically, in the light-emission driving stage S3 of the pixel circuit, the scanning signal GATE is at high level, the light-emission control signal EM is at low level, the fifth transistor T5 and the sixth transistor T6 are turned on, the potential of the first node N1 is changed to the voltage of the light-emission control signal EM (i.e., $V_{EM}$), the second node N2 is floating because the second transistor T2 and the fourth transistor T4 are turned off, bootstrap of the storage capacitor Cs happens (since voltages at the two terminals of the capacitor cannot be changed abruptly, and there is a voltage difference between the first node N1 and the second node N2, the voltage of the second node N2 also changes when the voltage of the first node N1 is changed, so as to maintain the original voltage difference between the second node N2 and the first node N1). According to the principle of charge conservation q=UCs, a voltage difference ΔV between the two terminals of the storage capacitor Cs (i.e., the voltage difference between the first node N1 and the second node N2) is kept unchanged in the compensation charging stage S2 and the light-emission driving stage S3, let the potential of the second node N2 at that time be X, then Vdd+Vth-Vdata=X-$V_{EM}$, from which it can be deduced that X=Vdd+Vth-Vdata+$V_{EM}$. As for the third transistor T3 which serves as the driving transistor, the gate-source voltage thereof is $V_{GS}$=X-Vdd=Vth-Vdata+$V_{EM}$. According to the current driving principle, a current I passing through the third transistor T3 at that time should be:

$$I = \frac{W\mu C_{ox}}{2L} \times (V_{GS} - V_{th})^2$$

$$\text{That is, } I = \frac{W\mu C_{ox}}{2L} \times (V_{th} - V_{data} + V_{EM} - V_{th})^2 = \frac{W\mu C_{ox}}{2L} \times (-V_{data} + V_{EM})^2$$

where W/L is a width-to-length ratio of the third transistor T3, $C_{OX}$ is capacitance of a gate oxide layer per unit area of the third transistor T3, and μ is carrier mobility of the third transistor T3.

It can be calculated from the above formula that the current passing through the third transistor T3 (i.e., a current passing through the light-emitting device 1) in the embodiment may be expressed as $K(V_{EM}\text{-Vdata})^2$ which shows that the current of the light-emitting device 1 is independent of the threshold voltage Vth of the driving transistor (i.e., the third transistor T3).

In an embodiment, in the reset and precharge stage S1 of the above method, duration of the first sub-stage is the same as that of the second sub-stage. Certainly, the duration of reset (the first sub-stage) may be set to be different from that of precharge (the second sub-stage), as long as the first and second nodes may be precharged to realize the threshold compensation. No limitation is made herein.

In an embodiment, all of the transistors, from the first transistor T1 to the eighth transistor T8, are P-type transistors, but no limitation is made herein by the present disclosure. In another embodiment, all of the transistors, from the first transistor T1 to the eighth transistor T8, may be N-type transistors. In another embodiment, from the first transistor T1 to the eighth transistor T8, some may be N-type transistors, and the others may be P-type transistors. In an embodiment, for example, when all of the transistors, from the first transistor T1 to the eighth transistor T8, are P-type transistors, each of the reset signal RST, the scanning signal GATE, the light-emission control signal EM and the data signal DATA is valid when being at low level, but no limitation is made herein by the present disclosure. In other embodiments, one or more of the reset signal RST, the scanning signal GATE, the light-emission control signal EM and the data signal DATA may be set as required to be valid when being at high level.

In the pixel circuit and the corresponding driving method thereof according to the embodiment, influence of the threshold voltage Vth of the driving transistor on the driving current of the OLED or QLED is eliminated by compensating for the threshold voltage of the driving transistor.

Another embodiment of the present disclosure provides a display device, including a plurality of the pixel circuits according to the above embodiment, and adopts the method for driving the pixel circuit according to the above embodiment.

The display device may be any product or component having a display function, such as a desktop computer, a tablet computer, a notebook computer, a mobile phone, a PDA, a GPS, a vehicle display, a projection display, a camera, a digital camera, an electronic watch, a calculator, an electronic instrument, a meter, electronic paper, a TV set, a monitor, a digital photo frame and a navigator, and may be applied in a plurality of fields, such as the fields of public display and unreal display.

The pixel circuit in the display device of the embodiment is prevented from being affected by the threshold voltage Vth of the driving transistor, thereby achieving uniform luminance and better display effect.

It should be understood that the foregoing implementations are merely exemplary implementations adopted for describing the principle of the present disclosure, but the present disclosure is not limited thereto. Those of ordinary skill in the art may make various variations and improvements without departing from the spirit and essence of the present disclosure, and these variations and improvements shall be considered to fall into the protection scope of the present disclosure.

What is claimed is:

1. A pixel circuit, comprising a reset and precharge sub-circuit, a scanning compensation sub-circuit, a driving sub-circuit and a light-emission control sub-circuit, wherein the scanning compensation sub-circuit comprises a storage capacitor, and wherein the light-emission control sub-circuit is configured to control a light-emitting device to emit light;

the reset and precharge sub-circuit is coupled to the scanning compensation sub-circuit and the light-emission control sub-circuit, and is configured to reset the light-emission control sub-circuit according to a reset signal, and reset a second electrode of the storage capacitor of the scanning compensation sub-circuit according to a scanning signal;

the scanning compensation sub-circuit is further coupled to the driving sub-circuit and the light-emission control sub-circuit, and is configured to charge the storage capacitor of the scanning compensation sub-circuit according to the scanning signal, so as to compensate for the driving sub-circuit;

the driving sub-circuit is further coupled to the light-emission control sub-circuit, and is configured to provide a driving current for the light-emitting device via the light-emission control sub-circuit; and the light-emission control sub-circuit is further coupled to the light-emitting device, and is configured to control the light-emitting device to emit light according to a light-emission control signal.

2. The pixel circuit of claim 1, wherein the scanning compensation sub-circuit further comprises a first transistor, a second transistor and a fourth transistor, wherein the first transistor has a control electrode used for receiving the scanning signal, a first electrode coupled to a first electrode of the storage capacitor, and a second electrode used for receiving a data signal;

the second transistor has a control electrode used for receiving the scanning signal, a first electrode coupled to the driving sub-circuit and the light-emission control sub-circuit, and a second electrode coupled to a second electrode of the fourth transistor and the reset and precharge sub-circuit;

the fourth transistor has a control electrode used for receiving the scanning signal, a first electrode coupled to the second electrode of the storage capacitor and the driving sub-circuit, and the second electrode further coupled to the reset and precharge sub-circuit; and the first electrode of the storage capacitor is further coupled to the light-emission control sub-circuit and serves as a first node, and the second electrode of the storage capacitor is further coupled to the driving sub-circuit and serves as a second node.

3. The pixel circuit of claim 2, wherein the driving sub-circuit comprises a third transistor which has a control electrode coupled to the second node, a first electrode coupled to the first electrode of the second transistor and the light-emission control sub-circuit, and a second electrode used for receiving a first voltage.

4. The pixel circuit of claim 3, wherein the light-emission control sub-circuit comprises a fifth transistor and a sixth transistor, wherein the fifth transistor has a control electrode coupled to a first electrode thereof and used for receiving the light-emission control signal, and a second electrode coupled to the first node; and the sixth transistor has a control electrode used for receiving the light-emission control signal, a first electrode coupled to both the reset and precharge sub-circuit and the light-emitting device, and a second electrode coupled to the first electrode of the third transistor and the first electrode of the second transistor.

5. The pixel circuit of claim 4, wherein the reset and precharge sub-circuit comprises a seventh transistor and an eighth transistor, wherein the seventh transistor has a control electrode coupled to a first electrode thereof and used for receiving the reset signal, and a second electrode coupled to the second electrode of the fourth transistor; and the eighth transistor has a control electrode coupled to a first electrode thereof and used for receiving the reset signal, and a second electrode coupled to the first electrode of the sixth transistor and the light-emitting device.

6. The pixel circuit of claim 1, wherein the driving sub-circuit comprises a third transistor which has a control electrode coupled to the second electrode of the storage capacitor, a first electrode coupled to the scanning compensation sub-circuit and the light-emission control sub-circuit, and a second electrode used for receiving a first voltage.

7. The pixel circuit of claim 1, wherein the light-emission control sub-circuit comprises a fifth transistor and a sixth transistor, the fifth transistor has a control electrode coupled to a first electrode thereof and used for receiving the light-emission control signal, and a second electrode coupled to a first electrode of the storage capacitor; and the sixth transistor has a control electrode used for receiving the light-emission control signal, a first electrode coupled to both the reset and precharge sub-circuit and the light-emitting device, and a second electrode coupled to the driving sub-circuit and the scanning compensation sub-circuit.

8. The pixel circuit of claim 1, wherein the reset and precharge sub-circuit comprises a seventh transistor and an eighth transistor, the seventh transistor has a control electrode coupled to a first electrode thereof and used for receiving the reset signal, and a second electrode coupled to the scanning compensation sub-circuit; and the eighth transistor has a control electrode coupled to a first electrode thereof and used for receiving the reset signal, and a second electrode coupled to the light-emission control sub-circuit and the light-emitting device.

9. A display device, comprising a plurality of pixel circuits and a light-emitting device, wherein each of the plurality of pixel circuit is the pixel circuit of claim 1 for driving the light-emitting device to emit light.

10. The display device of claim 9, wherein the light-emitting device is an organic light-emitting diode or a quantum dot light emitting diode.

11. A method for driving a pixel circuit, wherein a pixel circuit comprises a reset and precharge sub-circuit, a scanning compensation sub-circuit, a driving sub-circuit and a light-emission control sub-circuit, wherein the scanning compensation sub-circuit comprises a storage capacitor, and wherein the light-emission control sub-circuit is configured to control a light-emitting device to emit light, the reset and precharge sub-circuit is coupled to the scanning compensation sub-circuit and the light-emission control sub-circuit, and is configured to reset the light-emission control sub-circuit according to a reset signal, and reset a second electrode of the storage capacitor of the scanning compensation sub-circuit according to a scanning signal, the scanning compensation sub-circuit is further coupled to the driving sub-circuit and the light-emission control sub-circuit, and is configured to charge the storage capacitor of the scanning compensation sub-circuit according to the scanning signal, so as to compensate for the driving sub-circuit, the driving sub-circuit is further coupled to the light-emission control sub-circuit, and is configured to provide a driving current for the light-emitting device via the light-emission control sub-circuit, and the light-emission control sub-circuit is further coupled to the light-emitting device, and is configured to control the light-emitting device to emit light according to a light-emission control signal, and the method comprises steps of:

in a reset and precharge stage, resetting the reset and precharge sub-circuit and precharging the storage capacitor of the scanning compensation sub-circuit according to the reset signal and the scanning signal;

in a compensation charging stage, charging the storage capacitor of the scanning compensation sub-circuit according to the scanning signal, so as to compensate for the driving sub-circuit; and in a light-emission driving stage, driving the light-emitting device to emit light according to the light-emission control signal and the data signal.

12. The method of claim 11, wherein the scanning compensation sub-circuit comprises a first transistor, a second transistor, a fourth transistor and the storage capacitor, wherein the storage capacitor has a first electrode serving as a first node, and a second electrode serving as a second node, the driving sub-circuit comprises a third transistor, the light-emission control sub-circuit comprises a fifth transistor and a sixth transistor, the reset and precharge sub-circuit comprises a seventh transistor and an eighth transistor;

the reset and precharge stage comprises a first sub-stage and a second sub-stage, and the method comprises steps of:

in the first sub-stage, validating the reset signal such that the seventh transistor and the eighth transistor are turned on; and in the second sub-stage, validating the reset signal and the scanning signal such that the first transistor, the second transistor and the fourth transistor are turned on, the first node is precharged to a voltage of the data signal, and a potential of the second node is at low level;

in the compensation charging stage, validating the scanning signal such that the first transistor, the second transistor and the fourth transistor are turned on, the control electrode and the first electrode of the third transistor are electrically coupled to each other, a potential of the first node is kept unchanged, and a voltage of the second node is charged via the third transistor; and in the light-emission driving stage, validating the light-emission control signal such that the fifth transistor and the sixth transistor are turned on, a voltage difference between the first node and the second node is maintained to be equal to that between the first node and the second node when the compensation charging stage is complete.

13. The method of claim 12, wherein in the light-emission driving stage, the fifth transistor and the sixth transistor are turned on and the second transistor and the fourth transistor are turned off, the potential of the first node is changed to a voltage of the light-emission control signal, and the second node is floating, and a current of the light-emitting device is $K(V_{EM}-Vdata)^2$, and $K=W\mu C_{OX}/2L$, where $V_{EM}$ is the voltage of the light-emission control signal, Vdata is the voltage of the data signal, W/L is a width-to-length ratio of the third transistor, $C_{OX}$ is capacitance of a gate oxide layer per unit area of the third transistor, and μ is carrier mobility of the third transistor.

14. The method of claim 12, wherein, in the reset and precharge stage, duration of the first sub-stage is the same as that of the second sub-stage.

* * * * *